US008024910B2

(12) United States Patent
Graham et al.

(10) Patent No.: US 8,024,910 B2
(45) Date of Patent: Sep. 27, 2011

(54) METHODS AND APPARATUS FOR FORMING A CONTAINER

(75) Inventors: Thomas D. Graham, Winter Garden, FL (US); William Courteau, Hugo, MN (US); Amer Aganovic, Orlando, FL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 550 days.

(21) Appl. No.: 10/982,601

(22) Filed: Nov. 5, 2004

(65) Prior Publication Data

US 2006/0100079 A1 May 11, 2006

(51) Int. Cl.
*B65B 1/48* (2006.01)
*B31B 7/00* (2006.01)

(52) U.S. Cl. ..... 53/376.3; 493/70

(58) Field of Classification Search ..... 53/564, 53/376.3, 387.1; 493/69, 70, 71
See application file for complete search history.

(56) References Cited

U.S. PATENT DOCUMENTS

| | | | | |
|---|---|---|---|---|
| 3,461,642 | A * | 8/1969 | Jacobus et al. | 53/456 |
| 3,690,224 | A * | 9/1972 | Derderian et al. | 493/93 |
| 3,707,824 | A * | 1/1973 | Ishida et al. | 53/571 |
| 3,753,333 | A * | 8/1973 | Derderian et al. | 53/564 |
| 3,948,151 | A * | 4/1976 | Derderian | 493/128 |
| 4,211,053 | A * | 7/1980 | Niccolls | 53/386.1 |
| 4,662,150 | A | 5/1987 | Johnson et al. | |
| 4,932,930 | A | 6/1990 | Coalier et al. | |
| 5,147,271 | A | 9/1992 | Bacques et al. | |
| 5,598,685 | A | 2/1997 | Graham et al. | |

* cited by examiner

*Primary Examiner* — Rinaldi I. Rada
*Assistant Examiner* — John Paradiso
(74) *Attorney, Agent, or Firm* — Armstrong Teasdale LLP

(57) ABSTRACT

An apparatus for forming a container includes a frame, and a forming station coupled to the frame. The forming apparatus includes a plurality of folding plows configured to fold portions of a blank to form a container. The apparatus also includes a transfer assembly including a plurality of containment bars for supporting the container in a formed state. The containment bars facilitate retaining the formed state of the container while the transfer assembly transfers the container to an operator.

22 Claims, 7 Drawing Sheets

METHODS AND APPARATUS FOR FORMING A CONTAINER

BACKGROUND OF THE INVENTION

This invention relates generally to forming a container, and more particularly, to methods and apparatus for forming a container.

Many businesses are required to package materials before shipping the materials to other locations. Specifically, these businesses package products into containers for shipping and transportation. In at least some of these cases, the products are packaged in corrugated containers. In such a case, an operator manually erects and loads a corrugated paperboard carton from collapsed, partially assembled box blanks. One type of blank commonly used for packaging materials is a regular slotted container type commonly known as an R.S.C. type container. This type of blank requires folding of major and minor flaps at both the upper and lower ends of the blank to form the top and bottom walls of the container. The R.S.C. type blank often times includes four top wall flaps and four bottom wall flaps. When folded over, at least a portion of the four flaps overlap each other, thus leading to a container having additional thickness when compared to containers having only a single layer of corrugated paperboard material.

In at least some known applications, an operator must manually erect the container without the use of a forming machine by folding the flaps and sealing both the top and bottom walls of the container. As such, time and materials are required to form the container prior to the operator being able to load the materials into the container.

In response to the additional labor costs required to form such containers, at least some known folding machines have been developed to aid in the forming of such containers from R.S.C. type blanks. These known folding machines fold and secure the four bottom flaps with tape, staples, or glue, and then direct the container to the operator for loading.

BRIEF DESCRIPTION OF THE INVENTION

In one aspect, an apparatus is provided for forming a container. The apparatus includes a frame, and a forming station coupled to the frame. The forming apparatus includes a plurality of folding plows configured to fold portions of a blank to form a container. The apparatus also includes a transfer assembly including a plurality of containment bars for supporting the container in a formed state. The containment bars facilitate retaining the formed state of the container while the transfer assembly transfers the container to an operator.

In another aspect, a container packing system is provided for packing a container formed from a blank. The blank includes a bottom panel defining a footprint of the container, a plurality of end panels having minor flaps extending therefrom, and a plurality of side panels, wherein the end panels and the side panels form the sidewalls of the container. The container packing system includes a frame, a blank hopper coupled to the frame and configured to house at least one blank, and a forming station configured to receive a single blank from the blank hopper. The forming station includes minor flap folding plows configured to fold the minor flaps, end panel folding plows configured to fold the end panels, and side panel folding plows configured to fold the side panels. The forming station is configured to form the blank into a container. The container packing system also includes a transfer assembly including a container support assembly for supporting the container in a formed state. The transfer assembly is configured to transfer the container support assembly to an operator. The container packing system also includes an operator loading station for packing items into the formed container.

In a further aspect, a method is provided for packing a container. The method includes providing at least one blank having a predetermined pattern, directing the blank through a forming station having a plurality of plow fingers oriented to contact corresponding portions of the blank when the blank is directed through the forming station, and folding portions of the blank using the plow fingers to form a container. The method also includes supporting the formed container with a container support assembly such that the formed container retains the formed state, transferring the container from the forming station to an operator loading station using a transfer assembly, and packing the container with at least one item.

DETAILED DESCRIPTION OF THE INVENTION

Figure 1:
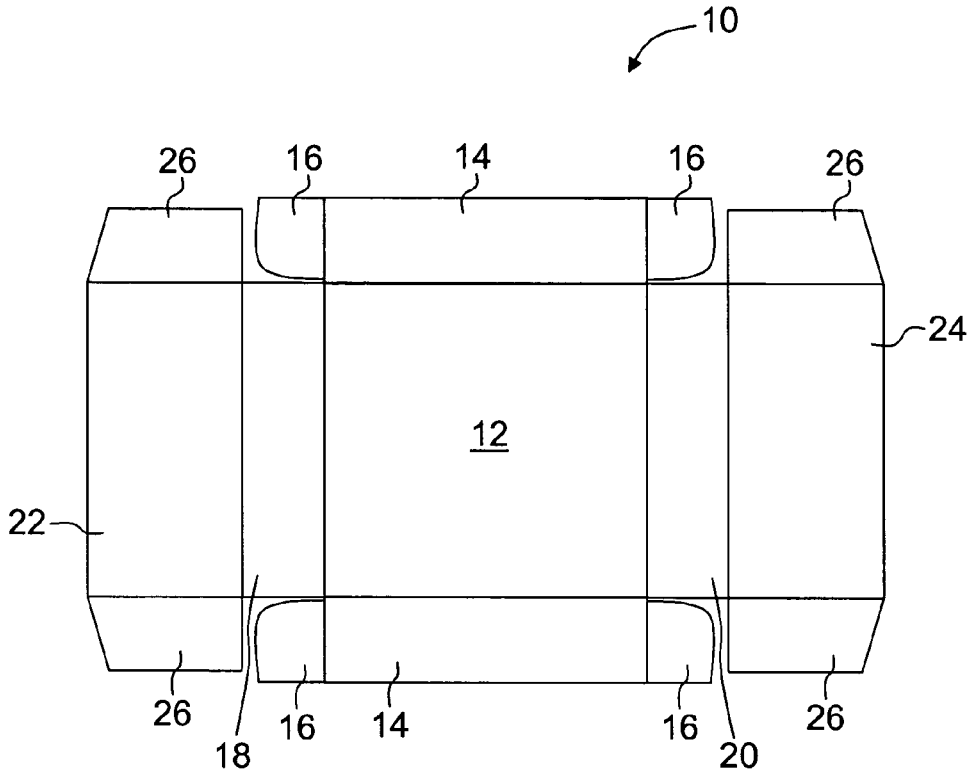
FIG. 1 is an exemplary embodiment of a solid bottom, top load corrugated blank that may be utilized in accordance with one embodiment of the present invention.

FIG. 1 is an exemplary solid bottom, top load corrugated blank 10 that may be used within a container packing system as described herein. In the exemplary embodiment, blank 10 is fabricated from a corrugated material and is formed into a plurality of panels having fold lines defined between each of the panels. Blank 10 includes a bottom panel 12. In the exemplary embodiment, bottom panel 12 is rectangular, however, other patterns or shapes may be utilized in alternative embodiments. Bottom panel 12 defines the footprint of container when formed.

Blank 10 also includes end panels 14 extending along opposite sides of bottom panel 12. In the exemplary embodiment, end panels 14 extend along the entire length of the side of bottom panel 12. A fold axis is positioned between each end panel 14 and bottom panel 12. In the exemplary embodiment, blank 10 includes minor flaps 16 extending along opposite sides of each end panel 14. Specifically, minor flaps 16 extend from each side of end panels 14 and include a fold axis positioned between each minor flap 16 and corresponding end panel 14.

Blank 10 includes a front side panel 18 and a rear side panel 20 extending along opposite sides of bottom panel 12. In the exemplary embodiment, side panels 18 and 20 extend along the entire length of each side of bottom panel 12. A fold axis extends between bottom panel 12 and each side panel 18 and 20. In the exemplary embodiment, blank 10 includes a front top lid panel 22 extending along the side of front side panel 18, and a rear top lid panel 24 extending along the side of rear side panel 20. A fold axis extends between each side panel 18 or 20 and corresponding top lid panels 22 or 24. In the exemplary embodiment, blank 10 includes tuck flaps 26 extending along opposite sides of each top lid panel 22 and 24. A fold axis extends between each top lid panel 22 and 24 and each corresponding tuck flap 26.

Figure 2:
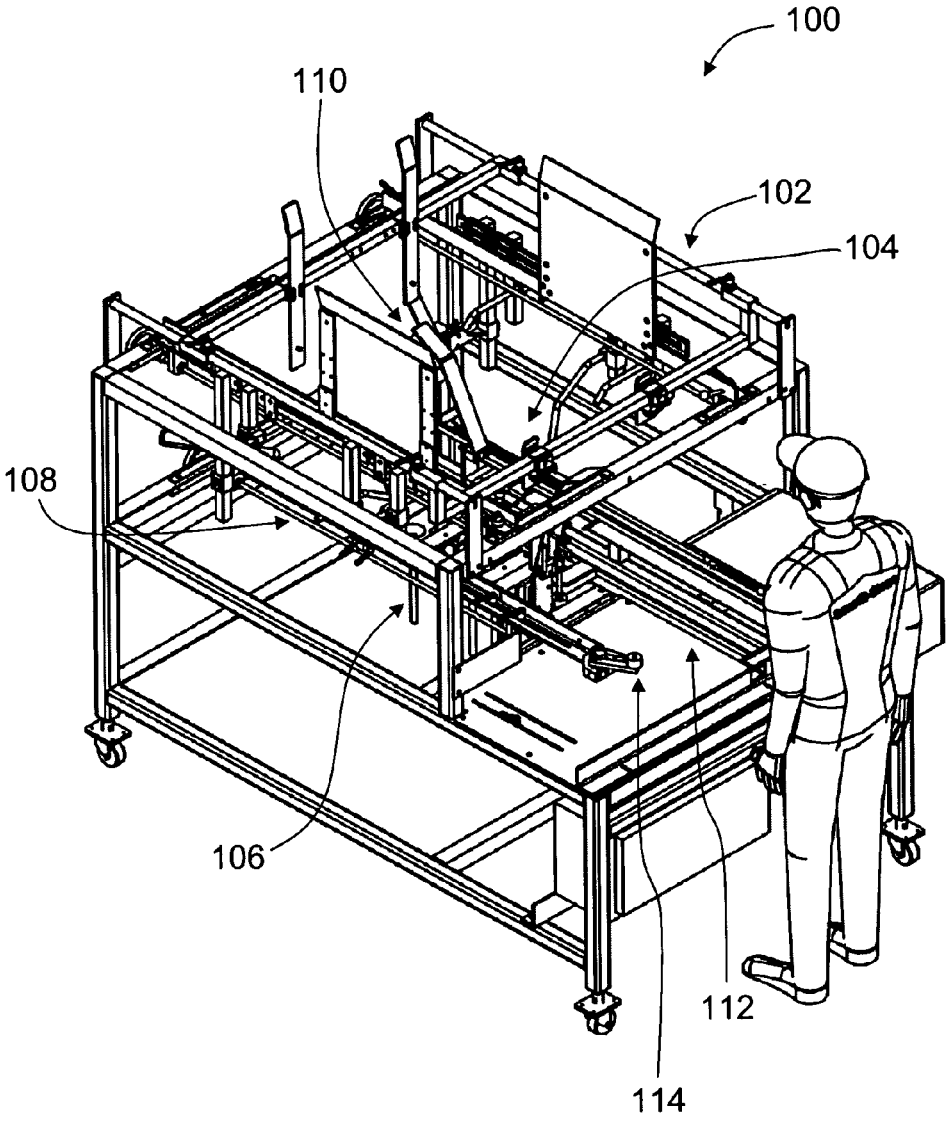
FIG. 2 is a perspective view of an exemplary container packing system in accordance with one embodiment of the present invention.

FIG. 2 is a perspective view of an exemplary embodiment of a container packing system 100 in accordance with one embodiment of the instant invention. In the exemplary embodiment, system 100 includes a blank hopper assembly 102, a forming station 104, a blank pick mechanism 106, an upper plow assembly 108, a lower plow assembly 110, a transfer assembly 112, and an operator loading station 114. System 100 facilitates forming a container, also referred to hereinafter as a tray, and directing the formed container to an operator 116 for loading with items, such as, for example, food items. System 100 also facilitates retaining the folded form of the container while operator 116 packs the items into the container. Specifically, system 100 facilitates retaining the folded form of the container while operator 116 is packing the container without the use of adhesive, glue, or other chemical or mechanical fasteners to form the container.

Figure 3:
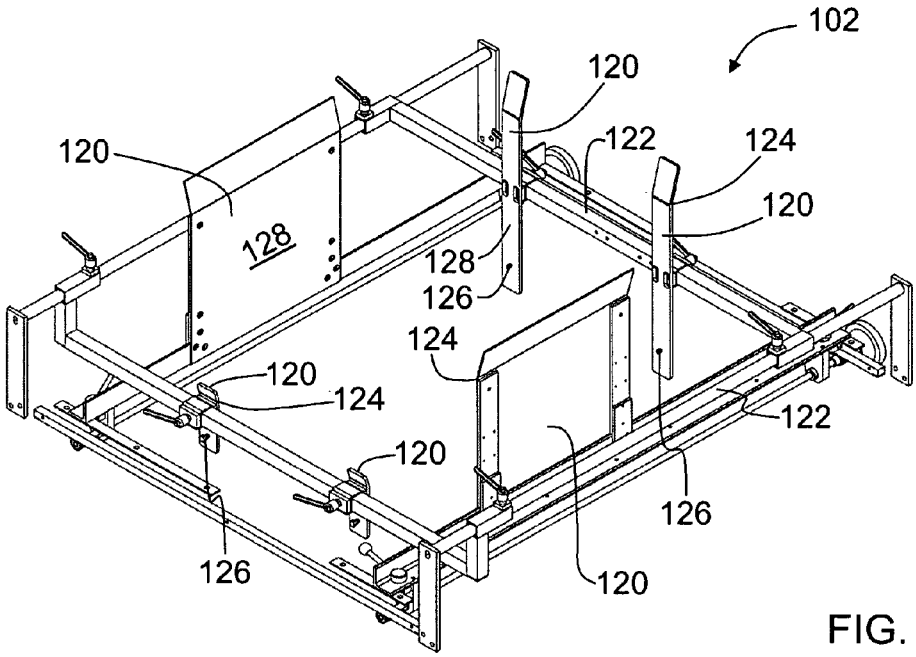
FIG. 3 is a perspective view of a blank hopper assembly in accordance with one embodiment of the present invention.

FIG. 3 is a perspective view of blank hopper assembly 102 (shown in FIG. 2). Hopper assembly 102 includes a plurality of guide members 120 coupled to a frame 122. Guide members 120 facilitate positioning blanks 10 (shown in FIG. 1) within container packing system 100 (shown in FIG. 2). In the exemplary embodiment, guide, members 120 are moveable with respect to frame 122 to accommodate for blanks 10 of multiple sizes. Guide members 120 are outwardly tapered proximate a top edge 124 of each guide member 120 to facilitate loading of a stack of blanks 10 into hopper assembly 102. In the exemplary embodiment, guide members 120 include pins 126 extending outwardly from an inner surface 128 of each guide member 120. Pins 126 facilitate supporting blanks 10 within hopper assembly 102 during operation of system 100. As illustrated in FIG. 2, hopper assembly 102 is positioned proximate a top portion of container packing system 100. As such, blanks 10 are drawn downward to begin the forming process.

Figure 4:
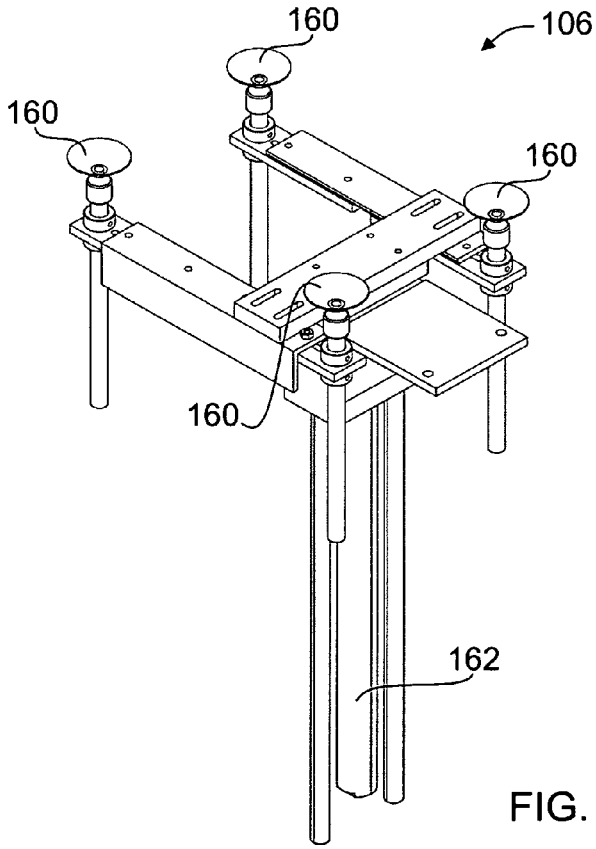
FIG. 4 is a perspective view of a blank pick mechanism in accordance with one embodiment of the present invention.

FIG. 4 is a perspective view of blank pick mechanism 106 (shown in FIG. 2). Blank pick mechanism 106 includes a plurality of vacuum cups 160 positioned a distance apart from each other on a substantially horizontal plane. Vacuum cups 160 are coupled to a venturi vacuum system (not shown) for creating a vacuum within vacuum cups 160. In one embodiment, each vacuum cup 160 is coupled to an individual vacuum system. In an alternative embodiment, blank pick mechanism 106 includes a single vacuum cup 160. Blank pick mechanism 106 includes an actuating mechanism 162, such as, for example, a pneumatic cylinder. Actuating mechanism 162 facilitates guiding vacuum cups 160 in a substantially vertical direction when blank pick mechanism 106 is in use. Specifically, as illustrated in FIG. 2, blank pick mechanism 106 is oriented substantially vertically below hopper assembly 102 and forming station 104. In operation, blank pick mechanism 106 ascends in a direction towards hopper assembly 102 until vacuum cups 160 contact blank 10 (shown in FIG. 1) within hopper assembly 102 and then descend with a single blank 10 through forming station 104. Specifically, as blank pick mechanism 106 descends, blank 10 is directed through forming station 104. In an alternative embodiment, blank pick mechanism 106 is actuated from above blank hopper assembly 102 such that blank 10 is forced downward through forming station 104. In such alternative embodiment, blank pick mechanism 106 may include vacuum cups 160, or may include another mechanism for coupling pick mechanism 106 to blank 10 for forming a container from blank 10.

Figure 5:
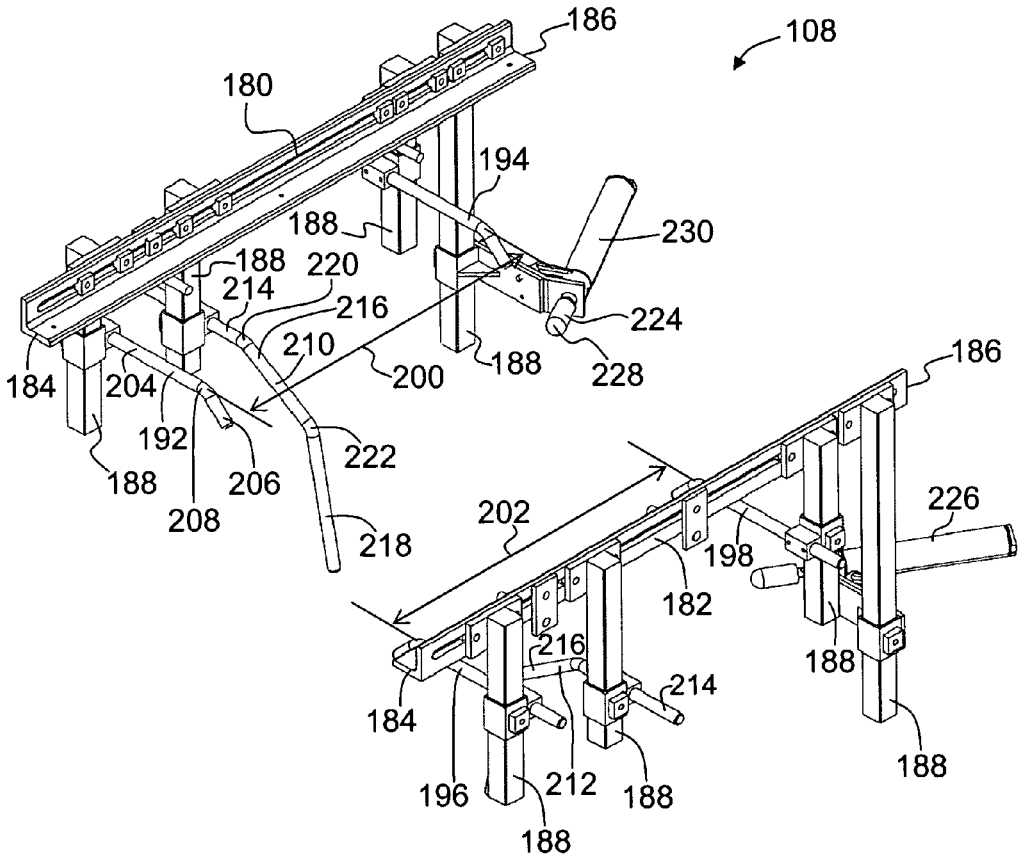
FIG. 5 is a perspective view of an upper plow assembly in accordance with one embodiment of the present invention.

FIG. 5 is a perspective view of upper plow assembly 108 (shown in FIG. 2). Upper plow assembly 108 forms a portion of forming station 104 (shown in FIG. 2). Specifically, upper plow assembly 108 facilitates forming a portion of container from blank 10 (shown in FIG. 1). Upper plow assembly 108 includes a first frame member 180 and an opposite second frame member 182. Frame members 180 and 182 extend substantially parallel with respect to one another from a front end 184 to a back end 186 and are positioned within a substantially horizontal plane. Upper plow assembly 108 includes a plurality of arms 188 coupled to frame members 180 and 182. In the exemplary embodiment, arms 188 are variably positionable and moveable along frame members 180 and 182.

In the exemplary embodiment, upper plow assembly 108 includes a first minor flap folding plow 192, a second minor flap folding plow 194, a third minor flap folding plow 196, and a fourth minor flap folding plow 198. First and second minor flap folding plows 192 and 194 are positioned along first frame member 180 and are separated from one another by a first distance 200. Third and fourth minor flap folding plows 196 and 198 are positioned along second frame member 182 and are separated from one another by a second distance 202. Additionally, first and third minor flap folding plows 192 and 196 are aligned generally across from one another, and second and fourth minor flap folding plows 194 and 198 are aligned generally across from one another. Moreover, in the exemplary embodiment, minor flap folding plows 192, 194, 196, and 198 are positioned on a substantially horizontal common plane.

In the exemplary embodiment, each minor flap folding plow 192, 194, 196, and 198 includes a first portion 204, a second portion 206, and a radius portion 208 extending therebetween. In the exemplary embodiment, first portion 204 is coupled to and extends substantially perpendicularly from a respective arm 188 generally inwardly towards the opposite frame member 180 or 182. Second portion 206 extends obliquely with respect to first portion 204 and generally extends inwardly towards the opposite frame member 180 or 182 and downwardly with respect to first portion 204. The position of second portion 206 with respect to frame members 180 and 182 is variably selected by altering the attachment position of first portion 204 with respect to arm 188. Moreover, the orientation of minor flap folding plow 192, 194, 196, and 198 is variably selected in a predetermined configuration such that minor flap folding plow 192, 194, 196, and 198 are configured to contact blank minor flaps 16 (shown in FIG. 1).

In the exemplary embodiment, upper plow assembly 108 includes a first end panel folding plow 210 and a second end panel folding plow 212. First and second end panel folding plows 210 and 212 are aligned generally across from one another within upper plow assembly 108. In the exemplary embodiment, each end panel folding plow 210 and 212 includes a first portion 214, a second portion 216, a third portion 218, a first radius portion 220 extending between first and second portions 214 and 216, respectively, and a second radius portion 222 extending between second and third portions 216 and 218, respectively. In the exemplary embodiment, first portion 214 is coupled to and extends substantially perpendicularly from a respective arm 188 generally inwardly towards the opposite frame member 180 or 182. Second portion 216 extends obliquely with respect to first portion 214 and generally extends inwardly towards the opposite frame member 180 or 182 and downwardly with respect to first portion 214. Third portion 218 extends obliquely with respect to second portion 216 and generally extends inwardly towards the opposite frame member 180 or 182 and downwardly with respect to first portion 214 and second portion 216. The position of second and third portions 216 and 218 with respect to frame members 180 and 182 is variably selected by altering the attachment position of first portion 214 with respect to arm 188. Moreover, the orientation of end panel folding plows 210 and 212 is variably selected in a predetermined configuration such that end panel folding plows 210 and 212 are configured to contact corresponding blank end panels 14 (shown in FIG. 1).

In the exemplary embodiment, upper plow assembly 108 includes a first tuck flap folder 224 and a second tuck flap folder 226. First and second tuck flap folders 224 and 226 are aligned generally across from one another, and are positioned generally vertically below back end 186 of frame members 180 and 182. In the exemplary embodiment, each tuck flap folder 224 and 226 includes a contact portion 228 coupled to an actuating mechanism 230, such as, for example, a pneumatic cylinder. Actuating mechanism 230 is operatively coupled to a controller (not shown). Tuck flap folders 224 and 226 are oriented such that each contact portion 228 is configured to contact a corresponding blank tuck flap 26 (shown in FIG. 1). As such, tuck flaps 26 associated with rear top lid panel 24 (shown in FIG. 1) do not interfere with or contact end panel folding plows 210 or 212 as container is directed from forming station 104 (shown in FIG. 2) to operator loading station 114 (shown in FIG. 2).

Figure 6:
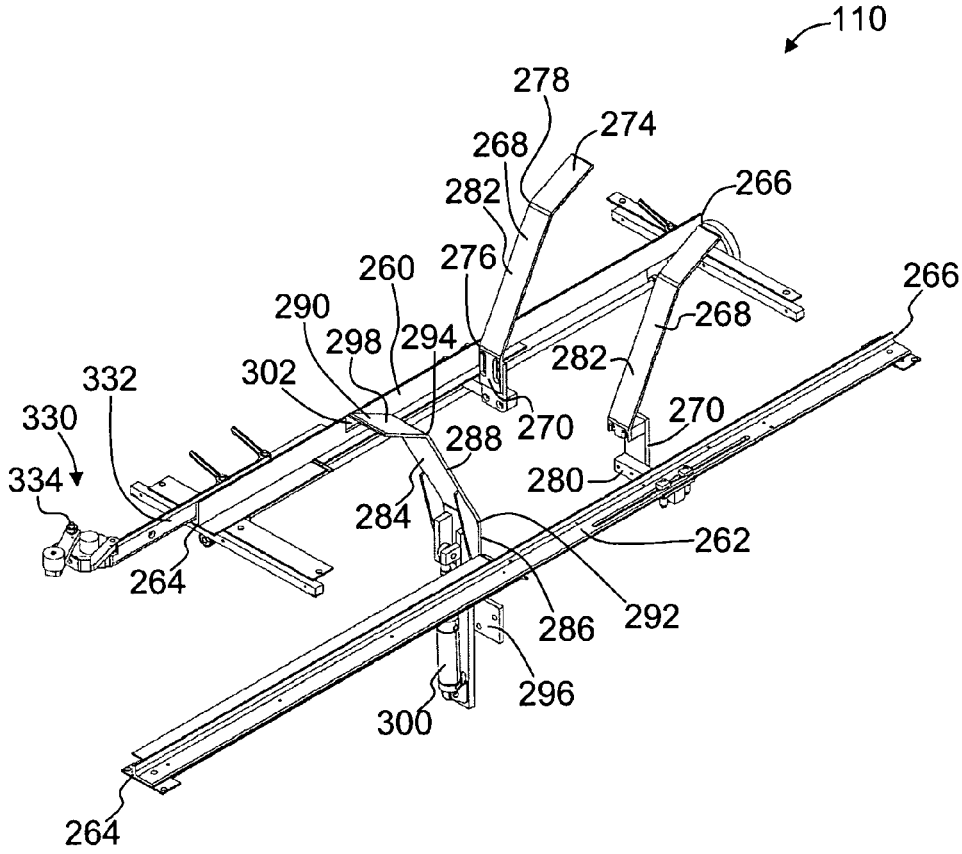
FIG. 6 is a perspective view of a lower plow assembly in accordance with one embodiment of the present invention.

FIG. 6 is a perspective view of lower plow assembly 110 (shown in FIG. 2). Lower plow assembly 110 forms a portion of forming station 104 (shown in FIG. 2). Specifically, lower plow assembly 110 facilitates forming a portion of container from blank 10. Lower plow assembly 110 includes a first frame member 260 and an opposite second frame member 262. Frame members 260 and 262 extend substantially parallel with respect to one another from a front end 264 to a back end 266. Lower plow assembly 110 includes a plurality of rear side panel folding plows 268 extending from frame members 260 and 262. In the exemplary embodiment, rear side panel folding plows 268 are variably positionable and moveable along frame members 260 and 262 to facilitate forming multiple sized blanks 10 (shown in FIG. 1).

In the exemplary embodiment, each rear side panel folding plow 268 includes a first portion 270, a second portion 272, a third portion 274, a first radius portion 276 extending between first and second portions 270 and 272, respectively, and a second radius portion 278 extending between second and third portions 272 and 274, respectively. In the exemplary embodiment, first portion 270 is coupled to and extends substantially vertically upward from a respective arm 280. Second portion 272 extends obliquely with respect to first portion 270 and generally extends outwardly and upwardly with respect to lower plow assembly 110. Third portion 274 extends obliquely with respect to second portion 272 and generally extends outwardly and upwardly with respect to lower plow assembly 110. The position of rear side panel folding plows 268 with respect to frame members 260 and 262 is variably selected by altering the attachment position of arm 280 with respect to frame members 260 and 262 to facilitate forming multiple sized blanks 10. Moreover, the orientation of rear side panel folding plows 268 is variably selected in a predetermined configuration such that an inner surface 282 of each rear side panel folding plow 268 is configured to contact blank rear side panel 20 (shown in FIG. 1).

In the exemplary embodiment, lower plow assembly 110 includes a front side panel folding plow 284 extending from frame member 262. In the exemplary embodiment, front side panel folding plow 284 is stationary with respect to frame member 262. In the exemplary embodiment, front side panel folding plow 284 includes a first portion 286, a second portion 288, a third portion 290, a first radius portion 292 extending between first and second portions 286 and 288, respectively, and a second radius portion 294 extending between second and third portions 288 and 290. In the exemplary embodiment, first portion 286 is coupled to and extends substantially vertically upward from a respective arm 296. Second portion 288 extends obliquely with respect to first portion 286 and generally extends outwardly and upwardly with respect to lower plow assembly 110. Third portion 290 extends obliquely with respect to second portion 286 and generally extends outwardly and upwardly with respect to lower plow assembly 110. The orientation of front side panel folding plow 284 is variably selected in a predetermined configuration such that an inner surface 298 of front side panel folding plow 284 is configured to contact blank front side panel 18 (shown in FIG. 1).

Lower plow assembly 110 also includes a folding plow actuating mechanism 300 coupled to front side panel folding plow 284. Actuating mechanism 300 facilitates adjusting the position of front side panel folding plow 284 between a loading position and an unloading position. In the loading position, as shown in FIG. 6, the front side panel folding plow 284 is in a substantially upright, or vertical, position, similar to the position illustrated in FIG. 6. As such, front side panel folding plow 284 facilitates forming the container when in the loading position. In the unloading position, front side panel folding plow 284 is in a substantially horizontal position (not shown) such that the formed container can be transferred from forming station 104. In the exemplary embodiment, actuating mechanism 300 is a pneumatic cylinder operatively coupled to a controller (not shown) for controlling the position of front side panel folding plow 284. In one embodiment, the controller is coupled to a photo-detection eye 302 positioned along frame member 260 to determine the presence or absence of a container in the line of sight of eye 302. Eye 302 transmits a signal to the controller relating to the presence of the container, and the controller operates actuating mechanism 300 accordingly. For example, in one embodiment, when the absence of a container is detected by eye 302, a signal is transmitted to the controller to activate actuating mechanism 300 to move front side panel folding plow 284 into the loading position.

Figure 7:
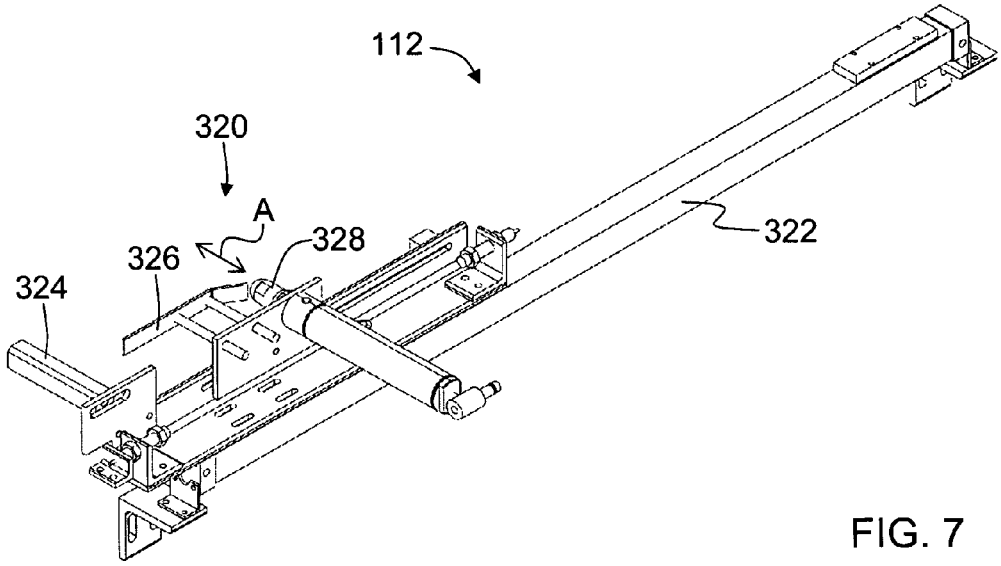
FIG. 7 is a perspective view of a transfer assembly in accordance with one embodiment of the present invention.

FIG. 7 is a perspective view of transfer assembly 112 (shown in FIG. 2). Transfer assembly 112 facilitates transferring a formed container from forming station 104 to operator loading station 114 (shown in FIG. 2). Specifically, transfer assembly 112 includes a container support assembly 320 to facilitate supporting panels of the formed container. Container support assembly 320 is moveable along a linear path of travel between an extended position and a retracted position. In the retracted position, container support assembly 320 is located proximate forming station 104. In the extended position, as shown in FIG. 7, container support assembly 320 is located proximate loading station 114. In the exemplary embodiment, transfer assembly 112 includes an actuating mechanism 322 to facilitate transferring container support assembly 320 along the path of travel. In one embodiment, actuating mechanism 322 is a pneumatic band cylinder. Actuating mechanism 322 is operatively coupled to a controller (not shown) that controls the operations of actuating mechanism 322.

In the exemplary embodiment, support assembly 320 includes a front side panel containment bar 324, an end panel containment bar 326, and a rear side panel containment bar 328. In the exemplary embodiment, rear side panel containment bar 328 is moveable in the direction of arrow "A". Specifically, rear side panel containment bar 328 is moveable between an extended, or supporting position, and a non-extended, or non-supporting, position, as shown in FIG. 7. In the extended position, rear side panel containment bar 328 contacts rear side panel 20 (shown in FIG. 1) of container. As such, rear side panel containment bar 328 facilitates supporting rear side panel 20 during transfer of container from forming station 104 to operator loading station 114. In the non-extended position, rear side panel containment bar 328 is positioned away from the container, which is located in the forming area, such that rear side panel containment bar 328 does not interfere with the forming process of the container. Once activated, rear side panel containment bar 328 moves to the extended position, and transfer assembly 112 is ready to transfer the container from forming station 104 to loading station 114. In one embodiment, rear side panel containment bar 328 is extended and retracted by a pneumatic cylinder operatively coupled to a controller (not shown). Rear side panel containment bar 328 is then de-activated such that support assembly 320 can be returned to forming station 104.

As further shown in FIG. 6, container packing system 100 (shown in FIG. 2) includes an end panel containment assembly 330 coupled to a frame member 332. In one embodiment, frame member 332 is coupled to lower plow assembly frame member 260. Frame member 332 is selectively positionable to facilitate positioning end panel containment assembly 330. Specifically, end panel containment assembly 330 is positioned to contact end panel 14 (shown in FIG. 1) of the container when the container is transferred to loading station 114 by transfer assembly 112. As such, end panel containment assembly 330 and container support assembly 320 (shown in FIG. 7) facilitate supporting each sidewall of the container during the packing of the container by operator (shown in FIG. 2). In the exemplary embodiment, end panel containment assembly 330 includes an actuating mechanism 334 to facilitate providing a biasing force against end panel 14 of the container when the container is positioned at loading station 114. In one embodiment, end panel containment assembly 330 is spring loaded.

Figure 8:
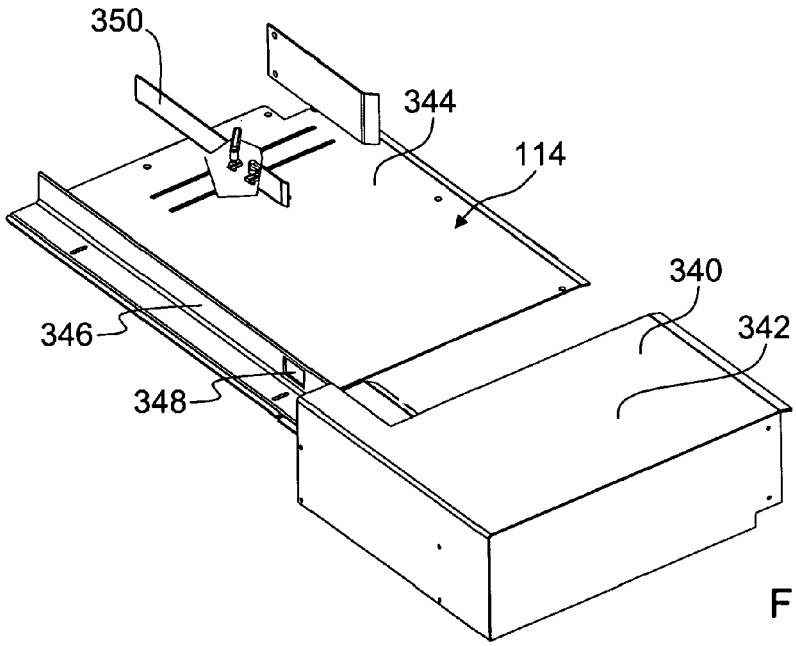
FIG. 8 is a perspective view of a loading station in accordance with one embodiment of the present invention.

FIG. 8 is a perspective view of loading station 114 (shown in FIG. 2). In the exemplary embodiment, loading station 114 includes a guard 340 having a flat top surface 342. As illustrated in FIG. 2, guard 340 surrounds transfer assembly 112, specifically container support assembly 320, to protect operator 116 (shown in FIG. 2) when transfer assembly 112 is transferred from the retracted position to the extended position. Loading station 114 also includes a deck 344 for supporting the container while operator 116 is loading or packing the container with items. Once the container is loaded, operator 116 closes the container. A front guide rail 346 extends along deck 344 to guide the container as operator 116 manually transfers the closed container out of loading station 114. In the exemplary embodiment, guide rail 346 includes a photo-detector eye 348 positioned along guide rail 346 to determine the presence or absence of a container in the line of sight of eye. Eye 348 transmits a signal to the controller relating to the presence or absence of the container. A rear guide rail 350 extends substantially perpendicularly with respect to front guide rail 346 along a portion of deck 344. In the exemplary embodiment, the position of rear guide rail 350 along deck 344 is variably selectable to accommodate multiple size containers.

In the exemplary embodiment, prior to operation of container packing system 100, operator 116 loads a stack of blanks 10 (shown in FIG. 1) in blank hopper assembly 102. During operation, blank pick mechanism 106 ascends to attach to a single blank 10 in blank hopper assembly 102. Blank pick mechanism 106 then descends through forming station 104, and as blank 10 descends through forming station 104, blank 10 is formed into a container. In the exemplary embodiment, blank 10 is sequentially formed into the container as blank is directed through forming station 104. Specifically, as blank 10 begins to descend, minor flaps 16 (shown in FIG. 1) contact and are folded by minor flap folding plows 192, 194, 196, and 198. As blank 10 is further descended, end panels 14 (shown in FIG. 1) contact and are folded by end panel folding plows 210 and 212. As blank 10 is further descended, side panels 18 and 20 (shown in FIG. 1) contact and are folded by side panel folding plows 268 and 284. As such, each of the panels are sequentially folded along respective fold axis to form the container. Additionally, when the container is within forming station 104, end panel folding plows 210 and 212 and rear side panel folding plows 268 maintain contact with respective panels of the container. As such, adhesive is not required for the container to maintain form. Front side panel folding plow 284 may be in contact with front side panel 18 when the container is in forming station 104, however, front side panel folding plow 284 must be in the unloading position before the container is transferred from forming station 104. Additionally, even when front side panel folding plow 284 is in the unloading position, front side panel 18 of the container is supported. Specifically, front side panel 18 is supported by container support assembly 320.

When the container is in the fully formed state, container support assembly 320 of transfer assembly 112 is positioned along respective portions of the container. Specifically, front side panel 18 is in contact with front side panel containment bar 324, and an end panel 14 is in contact with end panel containment bar 326. Additionally, once container is in the fully formed state, a controller transmits a signal to pneumatic cylinder to extend rear side panel containment bar 328. Once extended, transfer assembly 112 is ready to transfer the container from forming station 104 to loading station 114. In the exemplary embodiment, operator 116 operates a switch (not shown) to activate the transfer assembly 112. In one embodiment, the switch is a foot switch. Once activated, transfer assembly 112 guides the container to the operator loading station 114. As the container is transferred, end panels 14 and side panels 18 and 20 are fully supported such that the container retains a formed shape. In the fully extended position, one of end panel 14 is in contact with end panel containment assembly 330.

Once the container is transferred to loading station 114, the absence of a container is sensed by photo-detection eye 348, and a signal is sent to a controller relating to a demand for another container. A corresponding signal is transmitted from the controller to blank pick mechanism 106 to retrieve another blank 10. As such, a container is readily available for operator 116 when a demand is requested.

When the container is at loading station 114, operator 116 loads or packs the container with items for packaging. In one embodiment, the items are delivered to operator 116 by a conveyor system (not shown). Once the container is loaded, operator 116 folds tuck flaps 26 into the container and directs top lid panels 22 and 24 towards container, thereby closing the container. Once the top lid panels 22 and 24 are properly positioned, the container does not require additional external support from container support assembly 320. Once packaged and closed, the container is manually transferred from loading station 114. In one embodiment, the container is transferred from loading station 114 to a container sealing station (not shown) where an adhesive, such as packaging tape, is applied to the top lid panels 22 and 24 to seal the container from opening. Additionally, because blank 10 has a single, solid bottom panel 12, adhesive is not required to seal bottom panel 12. As the container is transferred from loading station 114, end panel containment assembly 330 is moved to allow the container to pass from loading station 114. Additionally, when the container is transferred, photo-detection eye 348 detects the absence of a container. A signal relating to the absence of a container is transmitted to a controller (not shown) and a corresponding signal is transmitted from the controller to transfer assembly 112. Specifically, rear side panel containment bar 328 is transferred to the non-extended position, and transfer assembly 112 transfers support assembly 320 to the retracted position. Once in the retracted position, support assembly 320 is configured to support the respective panels of the next container in forming station 104.

Figure 9:
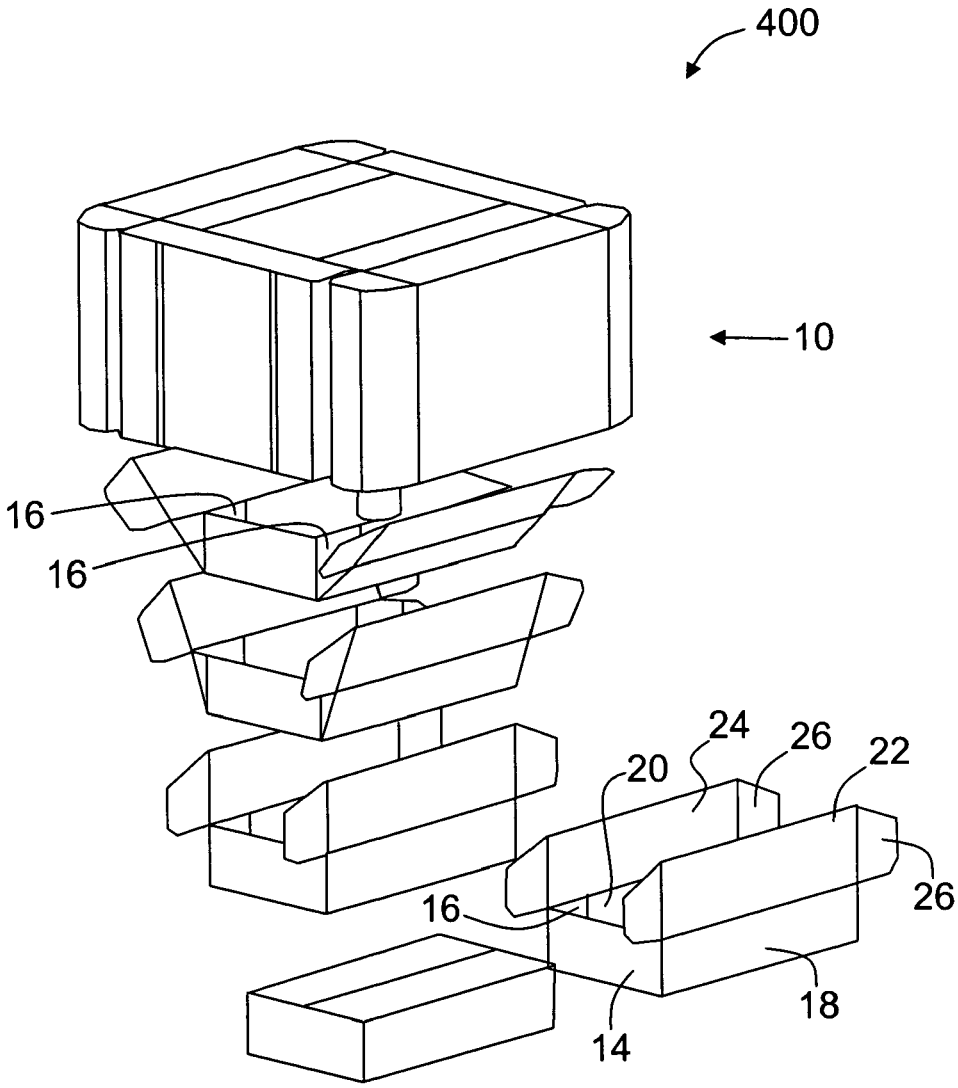
FIG. 9 illustrates an exemplary folding progression of a corrugated blank shown in FIG. 1.

FIG. 9 illustrates an exemplary folding progression 400 of blank 10 formed through a sequential forming process. In the exemplary embodiment, minor flaps 16 are inwardly folded along fold axis between minor flaps 16 and end panels 14. End panels 14 are then inwardly folded along fold axis between end panels 14 and bottom panel 12. Side panels 18 and 20 are then inwardly folded along fold axis between side panels 18 and 20 and bottom panel 12. Tuck flaps 26 are then inwardly folded along fold axis between tuck flaps 26 and top lid panels 22 and 24. Top lid panels 22 and 24 are then inwardly folded along fold axis between top lid panels 22 and 24 and side panels 18 and 20.

The container formed by such a process and from such a blank 10 provides a rigid container having additional vertical support due to the additional panels, such as, minor flaps 16 and tuck flaps 26, along end panels 14 and side panels 18 and 20. As such, the container can support additional weight, or layers of containers, stacked on top of the container. Additionally, the container formed by such a process and from such a blank 10 provides a stable container having a solid bottom panel 12. As such, additional assembly time, personnel, and materials are not required to secure the bottom panel 12 prior to packing the container. Moreover, by using a container packing system, such as system 100, additional assembly time and personnel are not required to form the container prior to packing the container, as system 100 automatically provides a container in a formed state and holds the container in the formed state until operator 116 secures the container.

The above-described container packing system 100 for forming a container for packing operates in a cost-effective and reliable manner. The container is formed from a blank 10 having a single bottom panel 12 and a plurality of flaps for forming the side walls and the top walls. The packing system 100 includes a forming station 104 for folding the major and minor flaps of the blank 10 in a sequential order such that a container is formed and presented to an operator for loading of items therein. Additionally, the packing system 100 includes a plurality of containment bars that retain the container in a formed state while the operator is loading the container. As a result, a packed container may be formed and loaded in a reliable and cost-effective manner.

Exemplary embodiments of container packing systems 100 are described above in detail. The packing systems 100 are not limited to the specific embodiments described herein, but rather, components of each packing system 100 may be utilized independently and separately from other components described herein. For example, each packing system 100 component can also be used in combination with other packing system 100 components.

While the invention has been described in terms of various specific embodiments, those skilled in the art will recognize that the invention can be practiced with modification within the spirit and scope of the claims.

What is claimed is:

1. A container packing system for packing a container formed from a blank, wherein the blank includes a bottom panel defining a footprint of the container, a plurality of end panels having minor flaps extending therefrom, and a plurality of side panels, wherein the end panels and the side panels form walls of the container, said container packing system comprising:

a frame comprising a plurality of frame members;

a blank hopper coupled to said frame and configured to house at least one blank, wherein said blank is horizontally disposed within the blank hopper;

a forming station substantially vertically aligned with said blank hopper and having a top end proximate said blank hopper and a bottom end opposite the top end, said forming station configured to receive a single blank from said blank hopper, said forming station comprising minor flap folding plows configured to fold the minor flaps, end panel folding plows configured to fold the end panels, and side panel folding plows attached to at least one of the plurality of frame members and configured to fold the side panels, said forming station configured to form the blank into a partially formed container without adhering any panel to any other panel or any flap, the partially formed container including at least a front wall, a rear wall, a first end wall, a second end wall, and at least one top panel in an at least partially open position, each wall extending substantially perpendicular to the bottom panel, at least one side panel folding plow attached to an actuation mechanism, and a first portion of the at least one side panel folding plow rotatable by the actuation mechanism from a first substantially vertical position to a second substantially horizontal position for enabling transfer of the partially formed container from said forming station after forming, and a second portion of the at least one side panel folding plow fixed in a stationary position with respect to the frame member that permits the first portion of the side panel folding plow to rotate around the fixed position;

a blank pick mechanism configured to transfer the single blank vertically downward from said blank hopper through said forming station, wherein the minor flap folding plows are positioned to engage and fold the minor flaps, the end panel folding plows are positioned to engage and fold the end panels, and the side panel folding plows are positioned to engage and fold the side panels when said blank pick mechanism transfers the single blank;

a transfer assembly comprising a container support assembly including a first containment bar and a second containment bar for supporting the partially formed container in a partially formed state at the bottom end of said forming station, said transfer assembly configured to extend the first containment bar into engagement with the partially formed container for transferring the partially formed container from said forming station after the at least one side panel folding plow rotates downward to the second substantially horizontal position; and an operator loading station for packing items into the partially formed container, said transfer assembly movable between the bottom end of said forming station and said operator loading station to transfer the partially formed container to an operator without any panel adhered to any other panel or flap.

2. A container packing system in accordance with claim 1 wherein said forming station is positioned below said blank hopper.

3. A container packing system in accordance with claim 1 wherein said blank pick mechanism comprises a vacuum device configured to attach to the blank to transfer the blank to said transfer assembly.

4. A container packing system in accordance with claim 1 wherein said minor flap folding plows, said end panel folding plows, and said side panel folding plows are configured to sequentially form the blank into the partially formed container.

5. A container packing system in accordance with claim 1 wherein said minor flap folding plows are coupled to said frame at a first substantially horizontal plane, said end panel folding plows are coupled to said frame at a second substantially horizontal plane, and said side panel folding plows are coupled to said frame at a third substantially horizontal plane, wherein said first substantially horizontal plane is oriented above said second substantially horizontal plane, and said second substantially horizontal plane is oriented above said third substantially horizontal plane, such that as the blank is directed through said forming apparatus the blank first contacts said minor flap folding plows, then the blank contacts said end panel folding plows, and then the blank contacts said side panel folding plows.

6. A container packing system in accordance with claim 1 further comprising at least one tuck flap folder for folding a portion of the side panel of the blank inwardly to facilitate transferring the partially formed container to an operator.

7. A container packing system in accordance with claim 1 wherein said plurality of folding plows are configured to simultaneously fold the minor flaps, end panels, and side panels as the blank is transferred from said blank hopper through said forming station by said blank pick mechanism.

8. A container packing system in accordance with claim 1 wherein said container support assembly comprises a plurality of containment bars each configured to contact a respective wall of the partially formed container to facilitate retaining the partially formed state of the partially formed container, the plurality of containment bars including the first containment bar and the second containment bar.

9. A container packing system in accordance with claim 8 wherein said end panel folding plows, at least one of said side panel folding plows, and said plurality of containment bars are configured to retain the partially formed container in the partially formed state while the container is transported from said forming station to said operator loading station.

10. A container packing system in accordance with claim 8 wherein the first containment bar is moveable between an extended and a non-extended position.

11. A container packing system in accordance with claim 1 further comprising a container sealing station for sealing a formed container, the formed container including the at least one top panel extending substantially parallel to the bottom panel in a closed position and engaging at least one of the walls to maintain the container in the formed state, said container sealing station configured to seal only the at least one top panel to maintain the at least one top panel in the closed position.

12. A container packing system in accordance with claim 1 further comprising a controller configured to control the operations of said container packing system.

13. A container packing system in accordance with claim 1 wherein the minor flap folding plows are positioned to initially fold the minor flaps of the blank, the end panel folding plows are positioned to fold the end flaps of the blank after the minor flaps are initially folded, and the side panel folding plows are positioned to fold the side panels of the blank after the end panels are folded.

14. A container packing system in accordance with claim 1 wherein the minor flap folding plows are positioned to fold the minor flaps of the blank to be substantially perpendicular to the end panels of the blank, the end panel folding plows are positioned to fold the end flaps of the blank to be substantially perpendicular to the bottom panel of the blank, and the side panel folding plows are positioned to fold the side panels of the blank to be substantially perpendicular to the bottom panel of the blank.

15. A container packing system in accordance with claim 1 wherein said transfer assembly is configured to support the partially formed container in the partially formed state without using glue.

16. A container packing system in accordance with claim 1 wherein said forming station comprises:

an upper plow assembly comprising the minor flap folding plows and the end panel folding plows; and a lower plow assembly comprising the side panel folding plows.

17. A container packing system in accordance with claim 1 wherein the at least one side panel folding plow is a front side panel folding plow configured to contact the front wall and the first containment bar is a rear containment bar configured to contact the rear wall.

18. A container packing system in accordance with claim 17 wherein the second containment bar is a front containment bar configured to support the front wall when the front side panel folding plow is rotated downward out of contact with the front wall.

19. A container packing system in accordance with claim 1 further comprising a controller configured to:

determine when the partially formed container is located within said operator loading station; and when the partially formed container is not located within said operator loading station, automatically position said transfer assembly at the bottom end of said forming station and activate said blank pick mechanism to transfer a second single blank vertically downward through said forming station to said transfer assembly to form a second partially formed container.

20. A container packing system in accordance with claim 1 further comprising a controller configured to:

receive a request from the operator to transfer the partially formed container from said forming station;

extend the first containment bar into engagement with a first wall of the partially formed container in response to the request;

rotate the at least one side panel folding plow downward out of engagement with a second wall of the partially formed container in response to the request, the second containment bar in contact with the second wall; and move said transfer assembly supporting the partially formed container from said forming assembly to said operator loading station.

21. A container packing system in accordance with claim 1 wherein said container support assembly is configured to move in a first direction from said operator loading station to said forming station and to move in an opposite, second direction from said forming station to said operator loading station.

22. A container packing system for packing a container formed from a blank, wherein the blank includes a bottom panel defining a footprint of the container, a plurality of end panels having minor flaps extending therefrom, and a plurality of side panels, wherein the end panels and the side panels form walls of the container, the container including at least a front wall, a rear wall, a first end wall, and a second end wall, each wall extending substantially perpendicular to the bottom panel, said container packing system comprising:

a frame comprising a plurality of frame members;

a blank hopper coupled to said frame and configured to house at least one blank;

a forming station substantially vertically aligned with said blank hopper and having a top end proximate said blank hopper and a bottom end opposite the top end, said forming station configured to receive a single blank from said blank hopper and form the single blank into the container, said forming station comprising:

minor flap folding plows configured to fold the minor flaps;

end panel folding plows attached to at least one of the plurality of frame members and configured to fold the end panels; and side panel folding plows configured to fold the side panels to form the container, at least one side panel folding plow attached to an actuation mechanism, and a first portion of the at least one side panel folding plow rotatable by the actuation mechanism from a first substantially vertical position to a second substantially horizontal position for enabling transfer of the partially formed container from said forming station after forming, and a second portion of the at least one side panel folding plow fixed in a stationary position with respect to the frame member that permits the first portion of the side panel folding plow to rotate around the fixed position;

a transfer assembly comprising a container support assembly including a first containment bar and a second containment bar for supporting the container in an at least partially formed state, said transfer assembly configured to extend the first containment bar into engagement with the container for transferring the container from said forming station after the at least one side panel folding plow rotates downward to the second substantially horizontal position;

a blank pick mechanism configured to transfer the single blank vertically downward from said blank hopper through said forming station to said transfer assembly, wherein the minor flap folding plows are positioned to engage and fold the minor flaps, the end panel folding plows are positioned to engage and fold the end panels, and the side panel folding plows are positioned to engage and fold the side panels when said blank pick mechanism transfers the single blank through said forming station; and an operator loading station for packing items into the container, said transfer assembly movable between the bottom end of said forming station and said operator loading station to transfer the container to an operator.

* * * * *